US006854934B2

(12) United States Patent
Yamane et al.

(10) Patent No.: US 6,854,934 B2
(45) Date of Patent: Feb. 15, 2005

(54) STRUCTURE OF PILE HEAD JOINT PORTION AND PILE HEAD FITTING TUBULAR BODY

(75) Inventors: Takashi Yamane, Hiroshima (JP); Yoshikazu Inatomi, Hiroshima (JP); Tsutomu Ogata, Tokyo (JP)

(73) Assignees: Kyokuto Corporation, Hiroshima (JP); Spice Sleeve Japan, Ltd., Tokyo (JP)

( * ) Notice: Subject to any disclaimer, the term of this patent is extended or adjusted under 35 U.S.C. 154(b) by 0 days.

(21) Appl. No.: 10/746,474

(22) Filed: Dec. 24, 2003

(65) Prior Publication Data

US 2004/0136787 A1 Jul. 15, 2004

(30) Foreign Application Priority Data

Dec. 25, 2002 (JP) ..... 2002-375310

(51) Int. Cl.[7] ..... E02D 5/12
(52) U.S. Cl. ..... 405/255; 405/229; 52/169.9
(58) Field of Search ..... 405/255, 251, 405/252; 52/169.9

(56) References Cited

U.S. PATENT DOCUMENTS 4,163,621 A * 8/1979 Higuchi ..... 405/255
4,245,931 A * 1/1981 Watts, Jr. ..... 405/255
6,102,627 A * 8/2000 Ueda et al. ..... 405/255
6,474,030 B1 * 11/2002 Ueda ..... 405/255

FOREIGN PATENT DOCUMENTS

JP 09-021141 1/1997

* cited by examiner

*Primary Examiner*—Frederick L. Lagman
(74) *Attorney, Agent, or Firm*—Apex Juris, pllc; Tracy M Heims

(57) ABSTRACT

The invention provides a structure of a pile head joint portion and a pile had fitting tubular body which can absorb an execution error for constructing a pile leading to a problem in the case of precasting a board for supporting an upper structure in order to intend to shorten a process, and can improve a strength of the pile head joint portion. A precast board (5) is manufactured by embedding a pile head fitting tubular body (2) which is constituted by a side plate (23) forming a pile head fitting tubular body (2) and a closing plate (22) closing open one end of a tube body, and forms an opening portion (26) in another end open so as to freely fit a pile head. The pile and the board are integrally formed by fitting the pile head portion to the pile head fitting tubular body (2) after constructing the pile, and charging an injection material (4) into the pile head fitting tubular body (2).

10 Claims, 6 Drawing Sheets

STRUCTURE OF PILE HEAD JOINT PORTION AND PILE HEAD FITTING TUBULAR BODY

BACKGROUND OF THE INVENTION

1. Field of the Invention

The present invention relates to a structure of a pile head joint portion for joining a pile head of a pile body and an upper structure, and a pile head fitting tubular body for fitting the pile head.

2. Description of the Prior Art

In the case of constructing an upper structure such as a bridge pier, a floor board, a building or the like on a head portion of the pile head, it is necessary to join the upper structure to the pile head.

The structure of the conventional pile head joint portion is formed by constructing a bottom board by a cast-in-place concrete in such a manner as to dig the pile head portion into the bottom board of the upper structure at a level of 10 cm to a diameter of the pile, after driving a precast pile and constructing a cast-in-place pile. In this case, in order to secure a strength of the pile head portion, a reinforcing bar is protruded into the bottom board from an end portion of the pile head, and the protruding reinforcing bar is reinforced by surrounding by a loop-shaped and spiral-shaped reinforcing bar. Further, as shown in Japanese Unexamined Patent Publication No. 9-21141, there is a construction method of integrally forming a pile and a box body by fitting the pile head to the steel box body provided with an opening portion for fitting the pile head therein after building group piles and casting the concrete into the box.

Further, as a construction method of constructing a cast-in-place pile and an embedded pile having a small bore diameter equal to or less than 30 cm (hereinafter referred to as a micro pile a), there is a micro pile construction method. The micro pile construction method is a construction method of piercing a steel tube (a casing) b into a supporting ground g while drilling a hole by a boring machine, inserting a reinforcing screw reinforcing bar d or the like into the steel tube b, and thereafter charging a grout c such as a cement milk, a mortar or the like. Further, in order to improve a pull-out resistance of the pile, a push-out shear resistance of the bottom board and the like, the micro pile a and the bottom board f are integrally formed by mounting a bearing plate e to the pile head portion, and thereafter casting in place the concrete of the bottom board f (refer to FIG. 6).

In the conventional structure of the pile head joint portion mentioned above, the following problems are generated.

(a) The reinforcing bar in the board supporting the upper structure, the reinforcing bar protruding from the pile head portion and the reinforcing bar reinforcing the same are complicated, or the bearing plate provided in the pile head portion is in the way, whereby it is hard to securely charge the concrete to the pile head joint portion, so that it is hard to secure a quality of the pile head joint portion.

(b) After constructing the pile body, since the upper structure is constructed by the cast-in-place concrete after processing the pile head portion, it is hard to shorten the process. Further, in the case of constructing the pile body in accordance with the micro pile construction method, the process required for constructing the pile body is shorter than the general pile body construction, however, since the bottom board is constructed by the cast-in-place concrete, it is hard to greatly shorten the process required for all of the construction of the pole and the bottom board.

SUMMARY OF THE INVENTION

The present invention is made in order to solve the conventional problems mentioned above, and an object of the present invention is to provide a structure of a pile head joint portion and a pile head fitting tubular body which can securely join a pile head and an upper structure.

Further, another object of the present invention is to provide a structure of a pile head joint portion and a pile head fitting tubular body which can secure a stable quality.

Further, the other object of the present invention is to provide a structure of a pile head joint portion which can greatly shorten the process required for constructing a pile body in a pile base structure, and a board joined with the pile body and supporting an upper structure.

The present invention achieves at least one of the objects mentioned above.

In order to achieve the object mentioned above, there is provided a structure of a pile head joint portion joining a pile head of a pile body and an upper structure, comprising:

a precast board embedding a pile head fitting tubular body for fitting the pile head therein;

the pile head fitted to the pile head fitting tubular body; and an injection material charging the space surrounded by the pile head fitting tubular body and the pile head, wherein the pile head filling tubular body is constituted by a side plate forming a tube body and closing plate for closing an open one end of the tube body, and another end forming an opening portion is opened so as to freely fit the pile head.

Further, the pile head fitted to the pile head fitting tubular body can be structured such that an outer periphery is formed in a threaded groove shape and a plurality of hollow frames are fitted in an axial direction of the pile head by an interval.

Further, the pile head fitting tubular body can be formed such that a projection portion is provided around an inner hollow surface of the side plate, the projection portion is provided in the axial direction of the pile head fitting tubular body by an interval, and an opening cross section of the opening portion is smaller than an inner hollow cross section of the side wall.

Further, the pile head fitting tubular body can be structured such that a plurality of projection portions are provided around an inner hollow surface or an outer peripheral surface of the side plate, the projection portions are provided in the axial direction of the pile head fitting tubular body by an interval, and an inner hollow cross section of the pile head fitting tubular body is reduced progressively toward the opening portion near the opening portion.

Further, the pile head fitting tubular body is structured such that the projection portions provided in the inner hollow surface of the side plate and an inner hollow cross section between the projection portions are reduced progressively toward a lower side in the axial direction of the pile head fitting tubular body.

Further, the structure can be made such that the pile head fitting tubular body is provided with a projection portion around an outer surface of the side plate, and the projection portion is provided in the axial direction of the pile head fitting tubular body by an interval.

DESCRIPTION OF THE EMBODIMENTS

Embodiment 1

A description will be given of an embodiment 1 in accordance with the present invention with reference to the accompanying drawings.

<a> Pile Head Joint Portion

A pile head joint portion 1 means a joint portion between a precast board 5 constituting a bottom board, a base stand or the like of an upper structure and a pile head of a pile body 3.

As a joint structure of the pile head joint portion 1, two kinds comprising a pin joint and a rigid joint are general.

In this case, the pin joint is, for example, a structure in which the pile head is embedded in the bottom board by about 10 cm. The upper structure (the bottom board) generates a horizontal displacement during earthquakes, however, since the pile body is pin joined with the bottom board in the pile head portion, the pile head portion rotates without being put under restraint by the bottom board so as to follow the horizontal displacement of the bottom board. The pin joint is generally advantageous in the respect that it is possible to make a bending moment generated in the pile body smaller than that of the rigid joint, and it is unnecessary to burden the bottom board with the bending moment from the pile body because no bending moment is generated in the pile head portion. On the other hand, the pin joint is disadvantageous in the respect that an amount of the horizontal displacement of the bottom board during earthquakes is greater than that of the rigid joint because that the binding force of the pile body against the horizontal displacement of the bottom board is weak.

Next, the rigid joint is, for example, a structure in which the pile head is embedded in the bottom board by about a pile diameter. In the case of the rigid joint, since the pile binds the bottom board at a time when the bottom board is horizontally displaced during earthquakes, it is possible to make the amount of the horizontal displacement of the bottom board smaller than that of the pin joint. However, since the pile body is put under restraint by the bottom board, the bending moment is generated in the pile head portion due to the horizontal displacement of the bottom board, and it is necessary to burden with the pile head bending moment applied to the bottom board.

Figure 1:
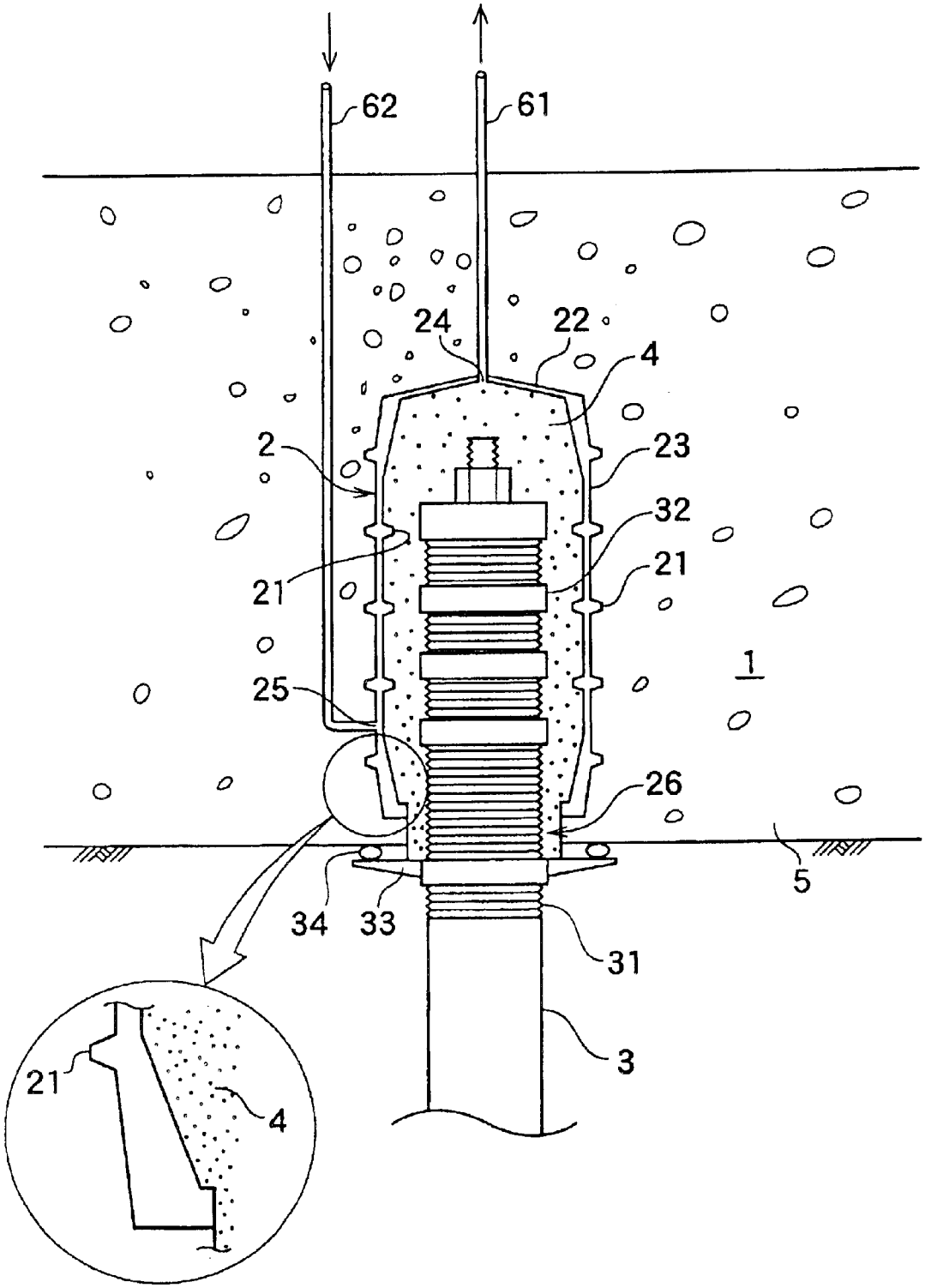
FIG. 1 is a cross sectional view describing an embodiment of a structure of a pile head joint portion in accordance with the present invention.

The present invention is structured, as shown in FIG. 1, such that the pile head portion is fitted to the precast board 5 embedding a pile head fitting tubular body 2 mentioned below therein. Both of the pin joint structure and the rigid joint structure can be achieved by adjusting a length of embedding the pile head fitting tubular body 2.

<b> Pile Head Fitting Tubular Body

The pile head fitting tubular body 2 is a tube body embedded in the precast board 5 mentioned below, and is structured such that a pile head portion of a pile body 3 constructed in the ground and protruding a head portion above the ground is fitted to an inner portion of the tube body (refer to FIGS. 1 and 2). The pile head fitting tubular body 2 is structured such that a side plate 23 structures a tube body, one open end of the tube body is closed by a closing plate 22, and another end of the tube body is formed as an opening portion 26 capable of fitting the pile head portion thereto.

A plurality of projection portions 21 are placed around an inner hollow surface and an outer hollow surface of the side plate 23 in an axial direction of the pile head fitting tubular body by an interval. In this case, the projection portions 21 may be provided all around the inner hollow surface of the outer hollow surface, or the projection portions 21 may be provided around the inner hollow surface or the outer hollow surface by an interval. The projection portions 21 are provided in the inner hollow surface of the side plate 23 for the purpose of preventing a hardened body of an injection material 4 mentioned below from being easily pulled out from the pile head fitting tubular body 2. Further, the projection portions 21 are provided in the outer surface of the side plate 23 for the purpose of preventing the pile head fitting tubular body 2 from being easily pulled out from the precast board 5.

Figure 4:
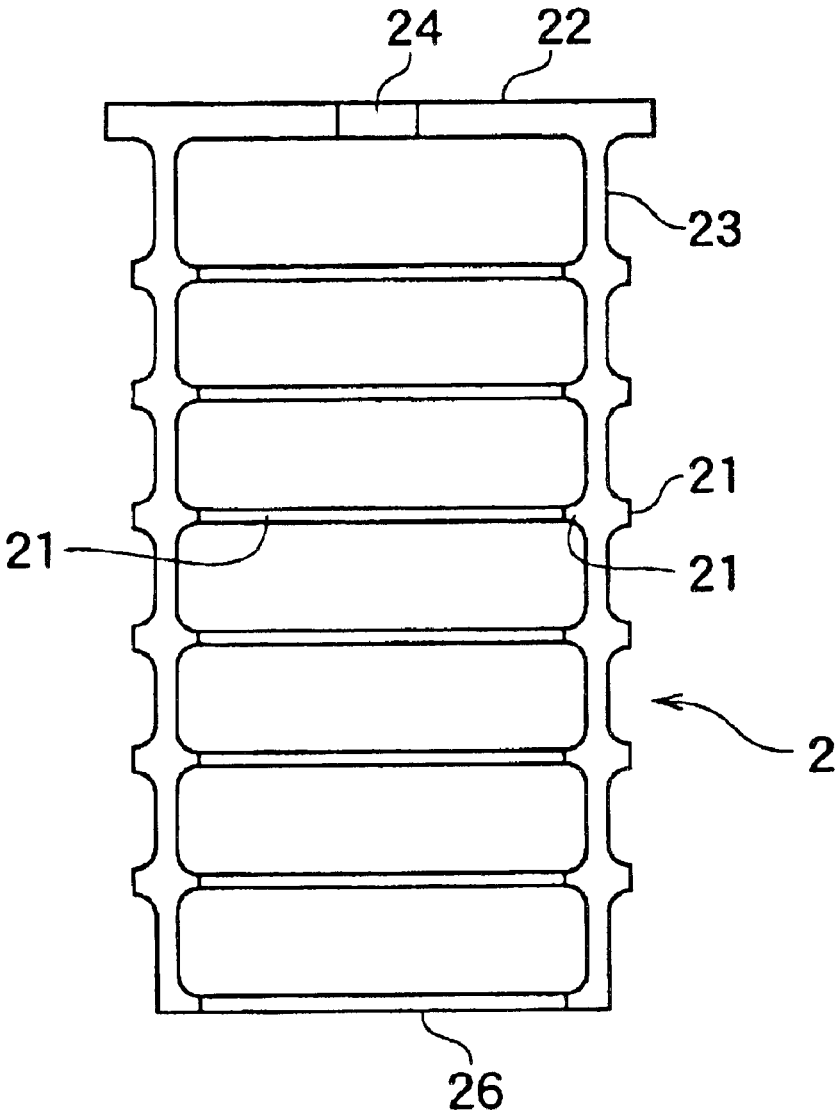
FIG. 4 is a vertical cross sectional view in the case where a closing plate is formed in a flat shape, in the pile head fitting tubular body in accordance with embodiment 1.

The closing plate 22 is, for example, formed in a cone shape, the cone-shaped closing plate 22 is connected to an end portion of the side plate 23 in a reverted state, and the closing plate 22 is placed so as to be embedded in the precast board 5. Further, in addition to the cone shape, the closing plate 22 may be formed in a flat shape (refer to FIG. 4).

Figure 2:
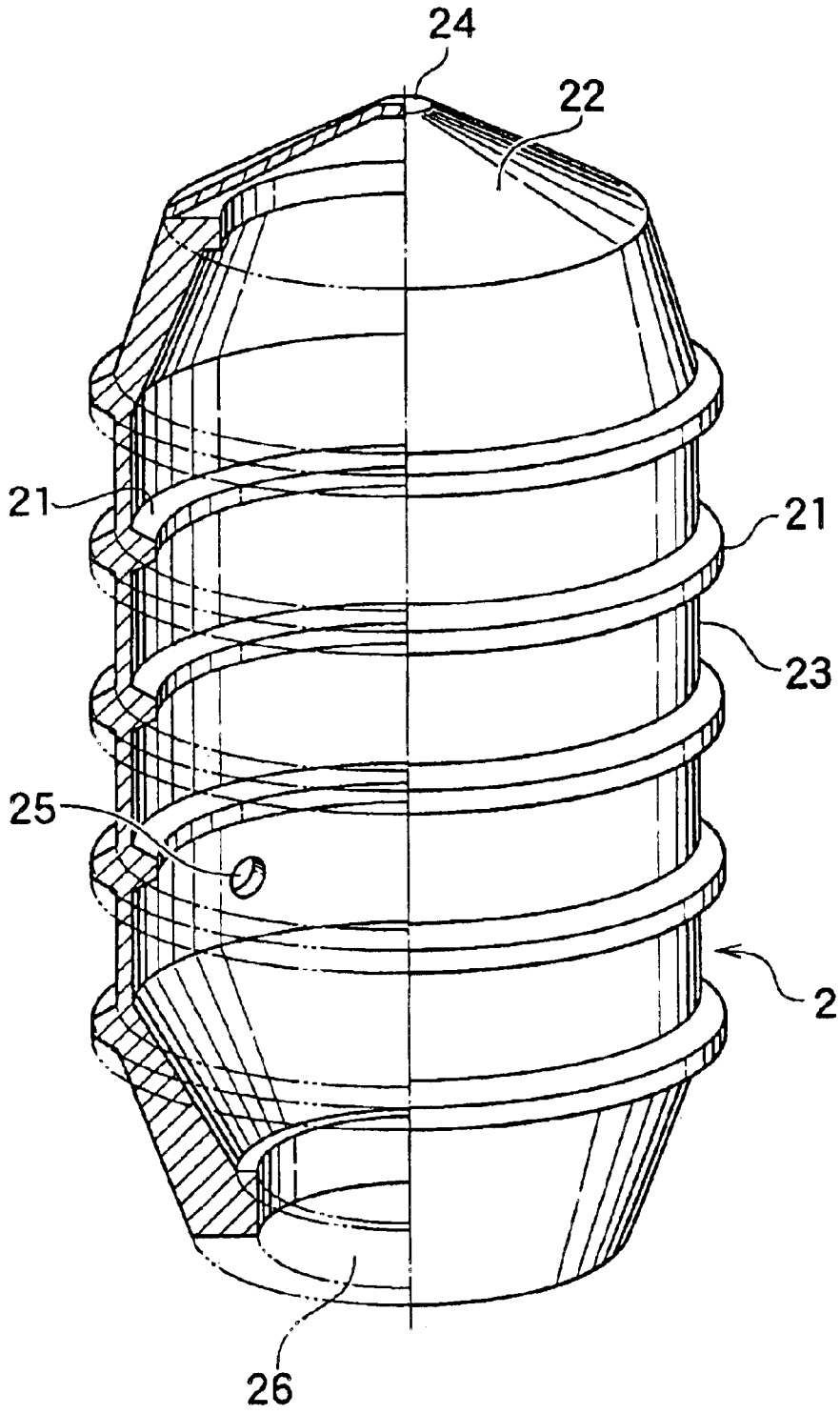
FIG. 2 is a perspective view of an embodiment of a pile head fitting tubular body in accordance with the present invention.

Further, the side plate 23 constituting the tube body may be formed as a polygonal tube or the like in addition to a circular cylinder (refer to FIG. 2).

It is preferable that an opening cross section of the opening portion 26 of the pile head fitting tubular body 2 is set to a size on the safe side with respect to the diameter of the pile taking into consideration a construction error generated by constructing the pile body 3.

The embedding length of the pile head fitting tubular body 2 in the precast board 5 can be freely adjusted in correspondence to the joint structure of the pile head, the pile diameter and the like.

It is preferable to form in such a manner that an opening cross section of the opening portion 26 is smaller than an inner hollow cross section of the side plate 23. This is because of making it hard for the hardened body of the injection material 4 mentioned below to be pulled out from the pile head fitting tubular body 2.

For example, it is possible to form in such a manner that the inner hollow cross section of the side plate 23 is reduced progressively toward the opening portion 26, near the opening portion 26. In other words, the inner hollow cross section of the side plate 23 is reduced progressively by forming in such a manner as to increase a thickness of the side plate 23 progressively toward the opening portion 26. The formation mentioned above is performed for the purpose of the following purposes. In other words, since the inner hollow cross section of the tube body is narrow in the opening portion 26, it is possible to efficiently charge and pressure insert the injection material 4 mentioned below. Since the hardened body of the injection material 4 is hard to be pulled out from the pile head fitting tubular body 2, it is possible to improve a binding effect achieved by the pile head fitting tubular body 2.

Further, the structure can be made such that a collar-shaped protruding portion is provided in the opening portion 26, thereby making the opening portion 26 narrow.

Further, the structure may be made such that the inner hollow cross section between the projection portion 21 and the projection portion 21 provided in the inner hollow surface of the side plate 23 is reduced progressively toward the lower side in the axial direction of the pile head fitting tubular body (not shown). This structure is provided for the purpose of making it hard for the hardened body of the injection material 4 to be pulled out from the pile head fitting tubular body 2.

Further, an injection hole 25 for injecting the injection material 4 mentioned below via an injection pipe 62 is provided in an optional position of the side plate 23. The injection hole 25 mentioned above may be provided at an optional position of the closing plate 22. Further, it is preferable to provide an exhaust hole 24 near a center of the closing plate 22 of the pile head fitting tubular body 2 in order to discharge air from the inner portion of the tube body at a time of charging the injection material 4 and control the injection. In this case, the structure may be made such that the injection pipe 62 is pierced into the exhaust hole 24 by using the injection hole 25 as the exhaust hole 24.

The pile head fitting tubular body 2 may be manufactured, for example, by a material such as a steel product, a ceramic, a cast iron or the like.

<c> Precast Board

Figure 6:
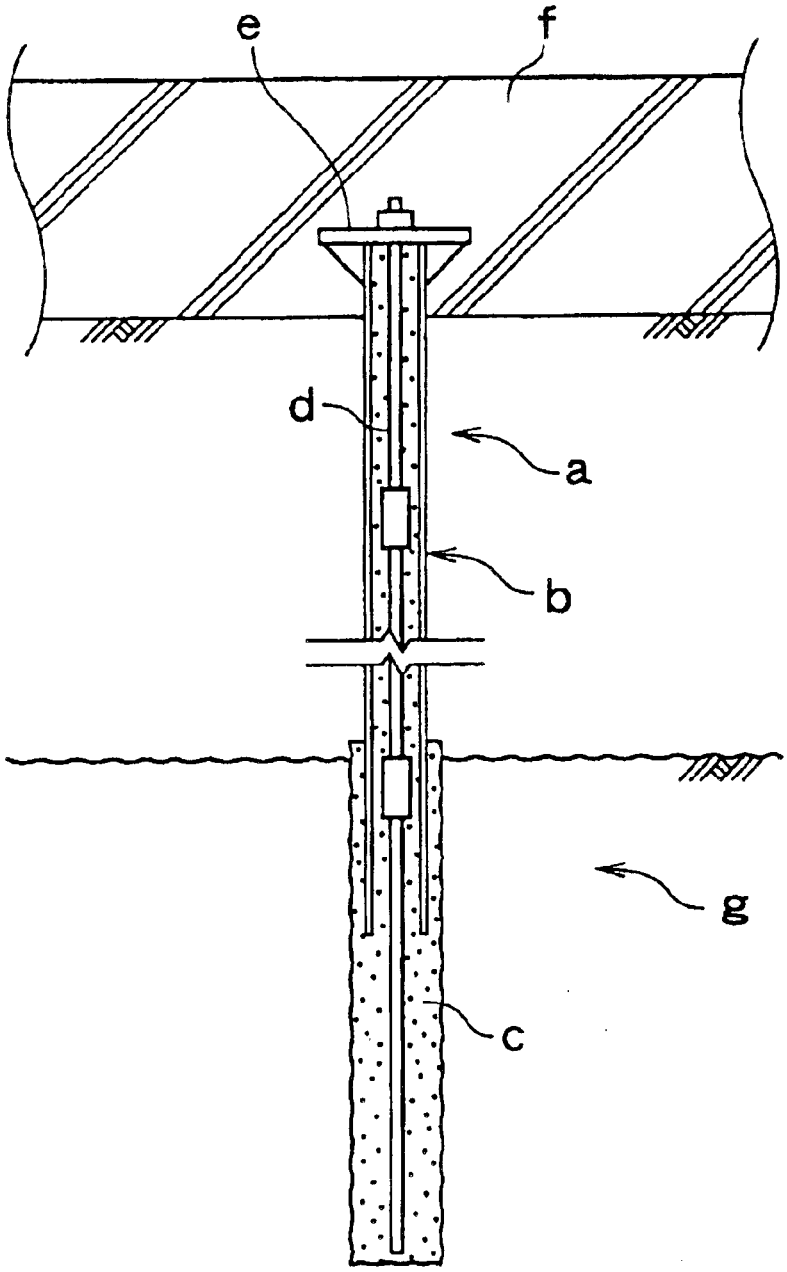
FIG. 6 is a cross sectional view describing a structure of a pile body and a pile head joint portion in accordance with the conventional micro pile construction method.

The precast board 5 is formed by precasting the board for supporting the upper structure. The conventional pile base structure is generally formed, for example, by constructing the bottom board by a cast-in-place concrete, after constructing the pile. In accordance with the constructing method mentioned above, since the bottom board can be constructed only after constructing the pile, it is hard to shorten a time for construction. In particular, in the case of constructing in accordance with the micro pile construction method shown in FIG. 6, the time for constructing the pile can be shortened by employing the construction method mentioned above in comparison with the conventional one. However, since the bottom board f is constructed by the cast-in-place concrete, it has not yet been possible to greatly shorten an entire process including the micro pile a and the bottom board f. Further, in the case that the bearing plate e is provided in the pile head portion as shown in FIG. 6, or the reinforcing bar for reinforcing the pile head is protruded from the pile head portion (not shown), there is generated a problem that the concrete is closed by the bearing plate e, the reinforcing bar for reinforcing the pile head, the main bar of the bottom board or the like, and it is hard to construct a dense bottom board.

Figure 3:
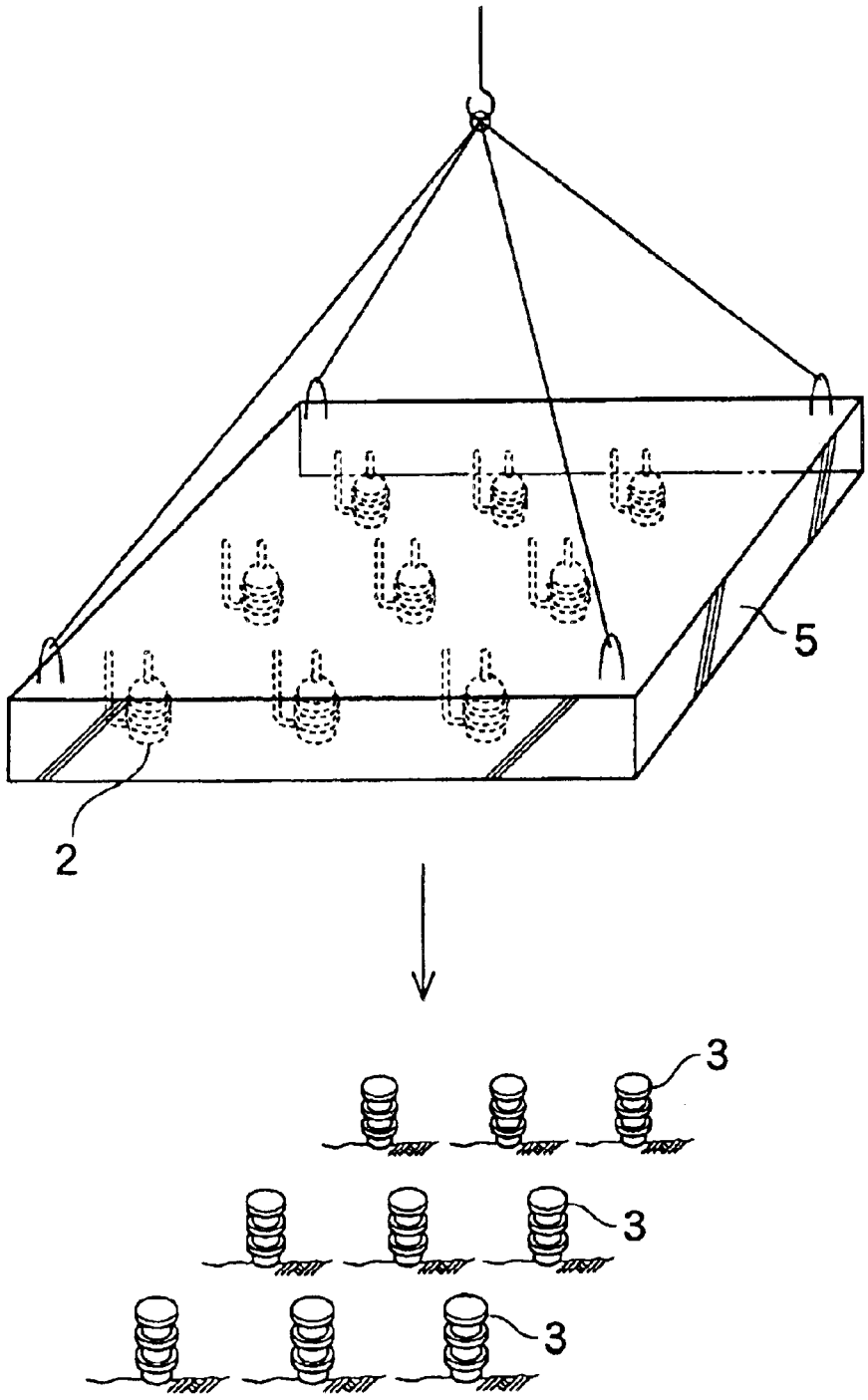
FIG. 3 is a schematic view showing a state in which a precast board is joined with a pile body.

In order to solve the problem mentioned above, the present invention intends to integrally form the pile and the board by constructing the precast board 5 embedding the pile head fitting tubular body 2 for fitting the pile head therein in a plant or a field yard and fitting the pile head portion to the pile head fitting tubular body 2 after constructing the pile (refer to FIG. 3). The exhaust pipe 61 connected to the exhaust hole 24 and the injection pipe 62 connected to the injection hole 25 are protruded from the upper surface of the precast board 5. It is possible to intend to integrally form the pile body 3 and the precast board 5 by placing so as to fit the pile head portion to the pile head fitting tubular body 2, thereafter charging the injection material 4 mentioned below into the inner portion of the pile head fitting tubular body 2 via the injection pile 62 and hardening the injection material 4. In this case, a mold form pedestal 33 is provided in a lower end portion of the pile head, and the precast board 5 is placed, for example, via a rubber packing 34 arranged on the mold form pedestal 33 as a buffering device. The mold form pedestal 33 is provided for the purpose of preventing the injection material 4 from being leaked from the lower side. Accordingly, the charged injection material 4 is charged from the portion near the mold form pedestal 33 toward an upper side within the pile head fitting tubular body 2.

It is possible to greatly shorten the step in comparison with the conventional one by precasting the board.

<d> Pile Body

The pile body 3 is structured such as to transmit a weight of the upper structure to the ground and to support the upper structure against an external force during earthquakes or the like. The pile body 3 includes a micro pile such as a cast-in-place pile, an embedded pile or the like having a small bore diameter equal to or less than 30 cm, a precast pile such as a steel pipe pile, a PHC pile or the like, a cast-in-place concrete pile and the like. Further, there is a small-bore pile constituted by a mortar used in a reinforcing construction of a slope surface or the like, a reinforcing bar and the like, a reinforcing columnar body obtained by inserting the steel product to a soil-cement improving the ground, and the like. Since one of the objects of the structure of the pile head joint portion in accordance with the present invention is to intend to shorten the time for construction, a particularly great effect can be obtained in the case that the micro pile having a comparatively short time required for constructing the pile is employed as the pile body 3.

The pile head of the pile body 3 used in the present invention can be provided with a threaded groove portion 31 on the surface of the pile head. The threaded groove portion 31 is provided for the purpose of making it hard to pull out the pile body 3 from the injection material 4 after being hardened mentioned below. Further, in order to further improve the pull-out preventing effect mentioned above, it is possible to use a structure in which a plurality of hollow frames 32 are fitted to the pile head. Since the protruding portion of the hollow frame 32 applies an effect of the bearing plate to the pulling out force in the axial direction of the pile body, it is further hard to pull out the pile body 3 from the injection material 4 after being hardened.

Further, it is preferable that a mold frame pedestal 33 for preventing the injection material 4 from leaking is provided in the lower end of the pile head, and a buffering device, for example, a rubber packing 34 or the like is provided between the precast board 5 and the mold frame pedestal 33.

<e> Injection Material

The injection material 4 is charged into the space surrounded by the pile head fitting tubular body 2 and the pile head from an injection pipe 62 protruding out to the upper surface of the precast board 5 after placing so as to fit the pile head portion to the pile head fitting tubular body 2 embedded in the precast board 5. In this case, the injection pipe 62 is connected to the injection hole 25 which is optionally provided in the side plate 23. In this case, the injection hole 25 can be provided at an optional position of the closing plate 22. Further, in order to exhaust the air within the pile head fitting tubular body 2 at a time of charging the injection material 4, the exhaust hole 24 is provided near a center of the closing plate 22, the exhaust pipe 61 is connected to the exhaust hole 24, and the exhaust pipe 61 is protruded from the upper surface of the precast board 5. The exhaust pipe 61 mentioned above can be used for confirming the injection of the injection material 4.

The injection material 4 and the pile head, and the injection material 4 and the pile head fitting tubular body 2 are respectively integrally formed in accordance with the hardening of the injection material 4, thereby intending to integrally form the precast board 5 and the pile body 3. In particular, in accordance with the present invention, since the pile head fitting tubular body 2 is formed in such a manner that the inner hollow cross section of the side plate 23 is reduced progressively toward the opening portion 26, or the opening cross section of the opening portion 26 is formed smaller than the inner hollow cross section of the side plate 23, it is possible to construct the hardened body of the injection material 4 having a higher restricting effect by means of the tube body, in comparison with the case without the formation mentioned above.

The injection material 4 can employ, for example, a cement grout material, no-contraction grout material, an expansive high strength grout material, a resin grout material and the like.

EXAMPLE

The pile head fitting tubular body 2 can be manufactured such that an inner diameter of the opening portion 26 is about 300 mm, and a length of the side plate 23 in an axial direction of the tube body is about 650 mm.

Further, the pile body 3 fitted to the pile head fitting tubular body 2 mentioned above can employ the pile body 3 having a pile diameter of about 200 mm.

Embodiment 2

A description will be given below of an embodiment 2 in accordance with the present invention with reference to the accompanying drawings. In this case, the overlapping portion with the embodiment 1 will be omitted.

Figure 5:
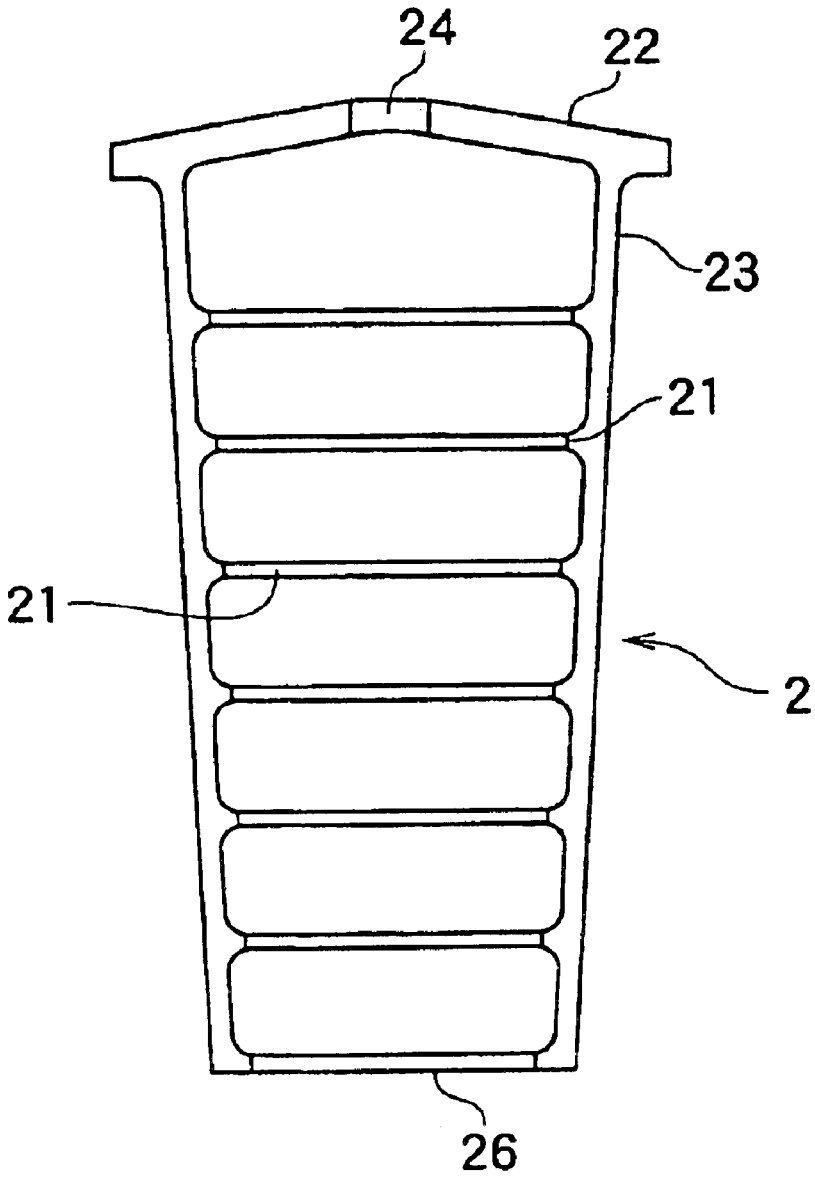
FIG. 5 is a vertical cross sectional view showing a pile head fitting tubular body in accordance with embodiment 2.

A shape of the side plate 23 constituting the pile head fitting tubular body 2 can be formed in such a shape that an outer cross section of the side plate 23 is expanded progressively toward the closing plate 22 from the opening portion 26 (refer to FIG. 5). By employing the shape mentioned above, it is possible to make the pile head fitting tubular body 2 hard to be pulled out from the precast board 2.

In this case, in the tube body having the side plate shape mentioned above, the projection portion 21 can be also provided on an inner hollow surface and an outer surface of the side plate.

Effect of the Invention

Since the structure of the pile head joint portion and the structure of the pile head fitting tubular body in accordance with the present invention are made as described above, the following effects can be obtained.

(a) Since it is unnecessary to provide the bearing plate or the like in the pile head portion, and the bottom board reinforcing bars, the reinforcing bars protruding from the pile head portion, the reinforcing bars reinforcing the same and the like are not complicated, it is possible to securely charge the injection material to the space surrounded by the pile head fitting tubular body and the pile body. Accordingly, it is possible to construct the structure of the pile head joint portion having a high quality.

(b) Since the injection material after being hardened is hard to be pulled out from the pile head fitting tubular body, it is possible to intend to improve the strength of the pile head joint portion.

(c) Since it is possible to shorten the process by precasting the board, and it is possible to achieve a great personnel reduction of the field worker, it is possible to make the construction cost inexpensive in comparison with the conventional structure.

What is claimed is:

1. A structure of a pile head joint portion joining a pile head of a pile body and an upper structure, comprising:

a precast board embedding a pile head fitting tubular body for fitting said pile head therein;

said pile head fitted to said pile head fitting tubular body; and an injection material charging a space surrounded by said pile head fitting tubula body and said pile head, wherein said pile head fitting tubular body is constituted by a side plate forming a tube body and closing plate for closing an open one end of the tube body, and another end forming an opening portion is designed so as to freely fit the pile head.

2. The structure of a pile head joint portion as claimed in claim 1, wherein said pile head is structured such that an outer periphery is formed in a threaded groove shape and a plurality of hollow frames are fitted in an axial direction of the pile head by an interval.

3. The structure of a pile head joint portion as claimed in claim 1 or 2, wherein a projection portion is provided around an inner hollow surface of said side plate, said projection portion is provided in the axial direction of said pile head fitting tubular body by an interval, and an opening cross section of said opening portion is smaller than an inner hollow cross section of said side wall.

4. The structure of a pile head joint portion as claimed in claim 1 or 2, wherein a plurality of projection portions are provided around an inner hollow surface of said side plate, said projection portions are provided in the axial direction of said pile head fitting tubular body by an interval, and an inner hollow cross section of said pile head fitting tubular body is reduced progressively toward the opening portion near said opening portion.

5. The structure of a pile head joint portion as claimed in claim 3, wherein said projection portions provided in the inner hollow surface of said side plate and an inner hollow cross section between the projection portions are reduced progressively toward a lower side in the axial direction of said pile head fitting tubular body.

6. The structure of a pile head joint portion as claimed in claim 3, wherein said projection portions provided in the inner hollow surface of said side plate and an inner hollow cross section between the projection portions are reduced progressively toward a lower side in the axial direction of said pile head fining tubular body.

7. The structure of a pile head joint portion as claimed in claim 4, wherein said projection portions provided in the inner hollow surface of said side plate and an inner hollow cross section between the projection portions are reduced progressively toward a lower side in the axial direction of said pile head fitting tubular body.

8. The structure of a pile head joint portion as claimed in claim 4, wherein said pile head fitting tubular body is provided with a projection portion around an outer surface of said side plate, and said projection portion is provided in the axial direction of said pile head fitting tubular body by an interval.

9. The structure of a pile head joint portion as claimed in claim 5, wherein said pile head fitting tubular body is provided with a projection portion around an outer surface of said side plate, and said projection portion is provided in the axial direction of said pile head fitting tubular body by an interval.

10. The structure of a pile head joint portion as claimed in claim 7, wherein said pile head fitting tubular body is provided with a projection portion around an outer surface of said side plate, and said projection portion is provided in the axial direction of said pile head fitting tubular body by an interval.

* * * * *